US006693065B2

(12) United States Patent
Gentilhomme et al.

(10) Patent No.: US 6,693,065 B2
(45) **Date of Patent: *Feb. 17, 2004**

(54) NON-FOAMING DETERGENT COMPOSITIONS FOR CONCENTRATED ALKALINE MEDIA

(75) Inventors: Philippe Gentilhomme, Goussainville (FR); Bernard Mourrut, Creil (FR)

(73) Assignee: Ceca S.A., Peteaux (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/347,574

(22) Filed: Jul. 6, 1999

(65) Prior Publication Data

US 2003/0078175 A1 Apr. 24, 2003

(30) Foreign Application Priority Data

Jul. 6, 1998 (FR) ..... 98 08608

(51) Int. Cl.[7] ..... C11D 3/00; C11D 3/20; C11D 3/36; B08B 7/00

(52) U.S. Cl. ..... 510/108; 510/214; 510/421; 510/423; 510/434; 510/435; 510/436; 134/42

(58) Field of Search ..... 510/108, 214, 510/413, 421, 423, 434, 435, 436; 134/42

(56) References Cited

U.S. PATENT DOCUMENTS

| | | | | | |
|---|---|---|---|---|---|
| 3,579,453 | A | | 5/1971 | Dupre et al. | 252/89 |
| 4,018,696 | A | | 4/1977 | Hellsten et al. | 252/135 |
| 4,024,072 | A | * | 5/1977 | Shane et al. | 516/123 |
| 4,137,190 | A | | 1/1979 | Chakrabarti et al. | 252/89 |
| 4,597,888 | A | | 7/1986 | King | 252/135 |
| 4,721,580 | A | * | 1/1988 | Gosselink | 510/297 |
| 4,744,916 | A | * | 5/1988 | Adams et al. | 510/304 |
| 4,786,431 | A | * | 11/1988 | Broze et al. | 510/304 |
| 4,793,942 | A | * | 12/1988 | Lokkesmoe et al. | 510/222 |
| 5,445,756 | A | * | 8/1995 | Didier et al. | 252/104 |
| 5,555,756 | A | * | 9/1996 | Fischer et al. | 72/41 |
| 5,634,979 | A | * | 6/1997 | Carlson et al. | 134/3 |
| 5,650,097 | A | * | 7/1997 | Wysong et al. | 252/392 |

FOREIGN PATENT DOCUMENTS

| | | | |
|---|---|---|---|
| EP | 0223306 | * | 5/1987 |
| GB | 1528171 A | * | 10/1975 |
| JP | 59196398 | * | 11/1984 |

* cited by examiner

*Primary Examiner*—Lorna M. Douyon
(74) *Attorney, Agent, or Firm*—Millen, White, Zelano & Branigan, P.C.

(57) ABSTRACT

Detergent compositions which are non-foaming and stable in highly alkaline medium, comprising 25 to 45% by weight of non-foaming detergent agent, in particular a capped nonionic surfactant, for example an α-alkyl-ω-halopoly (oxy-1,2-ethanediyl), or an α-decyl-ω-benzyloxypoly(oxy-1,2-ethanediyl), 15 to 25% by weight of stabilizer, in particular a phosphoric ester of a fatty alcohol, and 30 to 60% by weight of an alkenylsuccinic acid or anhydride, in particular octenylsuccinic acid or anhydride. These compositions allow the preparation of alkaline washing products for cleaning hard surfaces, which are themselves non-foaming, even under pressurized cleaning conditions.

17 Claims, No Drawings

NON-FOAMING DETERGENT COMPOSITIONS FOR CONCENTRATED ALKALINE MEDIA

FIELD OF THE INVENTION

The field of the present invention is that of industrial or household detergency.

BACKGROUND OF THE INVENTION

Aqueous alkaline solutions containing non-foaming surface agents are commonly used for degreasing hard surfaces, and more specifically for cleaning metal surfaces, floors, walls, tanks, various materials, bodywork, wheel rims or motors in an industrial environment, such as in an institutional environment (hospitals, canteens, restaurants, schools, etc.).

The surfaces agents selected for this purpose are very generally so-called "capped" nonionic surfactants. This refers to compounds having the following structure: a hydrophobic chain of the fatty alkyl or alkylaryl chain type, condensed with ethylene oxide forming a hydrophilic chain, which is itself topped with a hydrophobic group. These compounds are well represented by alcohols with an alkyl or alkylaryl chain containing 8–20 carbon atoms, and preferably 8–12 carbons, condensed with 4–14, preferably 8–10, ethylene oxide molecules, and ending with a hydrophobic group, consisting of an alkyl chain of 3–8 carbon atoms or an alkylaryl chain or a halogen. Such a surface agent is typically represented by α-alkyl-ω-halopoly(oxy-1,2-ethanediyls), such as the compound α-decyl-ω-chloronona (oxyethylene) of formula $$CH_3—(CH_2)_9—(O—CH_2—CH_2)_9—Cl$$

Surface agents of this type are sparingly soluble or even entirely insoluble in alkaline solutions, and the alkaline detergent solutions which contain them have a tendency to demix. This phenomenon is overcome by using stabilizers. Stabilizers are well known to those skilled in the art; among these are oxygenated solvents, sodium toluenesulphonate, sodium xylenesulphonate or sodium cumenesulphonate, and alkaline salts of phosphoric esters. They are used in considerable amounts, which can be up to ten parts per part of non-foaming detergent agent. These stabilizers do not participate in the detergency itself, and are the cause of a needless increase in the chemical oxygen demand and the biological oxygen demand (COD-BOD) of the detergent composition waste materials. They can even have the negative effect of giving the composition appreciable foaming power. Consequently, they no longer satisfy the problem of pressurized-jet cleaning.

SUMMARY OF THE INVENTION

It has just been found that compositions of the non-foaming detergent/stabilizer/alkenylsuccinic acid or anhydride type constitute bases for producing alkaline cleaning solutions, which are entirely noteworthy as regards their detergent efficacy, their COD/BOD kept within reasonable limits, their stability on storage and their absence of foaming, even under conditions of use with a pressurized jet.

For the purposes of the invention, the non-foaming detergent agent is a compound of formula $$R_1—(O—CH_2—CH_2)_n—R_2$$

in which $R_1$ is an alkyl chain of 8–20 carbon atoms, and preferably 8–12 carbons, or an octylphenyl or nonylphenly chain, n is from 8 to 15, $R_2$ is an alkoxy radical of 3–5 carbon atoms, a poly(oxyalkylene) radical of formula:

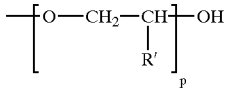

in which

R' is an alkyl radical containing 1 or 2 carbon atoms, p is from 1 to 10, a benzyloxy radical, or chlorine.

These compositions are formed of 25 to 45 parts by weight of the non-foaming detergent agent, 15 to 25 parts by weight of a stabilizer, 30 to 60 parts by weight of alkenylsuccinic acid or anhydride.

The stabilizer is a phosphoric ester of monoester/diester type, obtained by reaction of phosphorus pentoxide with an aliphatic alcohol containing from 4 to 12 carbon atoms; the alkenylsuccinic acid is a compound of formula

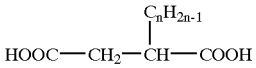

where n is from 4 to 12, and the anhydrides which are the immediate derivatives thereof.

The compositions combining α-decyl-ω-chloro-nona (oxyethylene)

$$CH_3—(CH_2)_9—(O—CH_2—CH_2)_9—Cl,$$

the α-decyl-ω-benzyloxytrideca(oxyethylene)

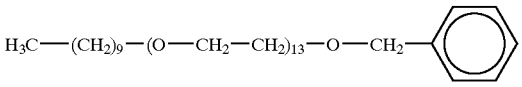

the phosphoric monoester/diester of 2-ethylhexyl, and octenylsuccinic acid, of formula:

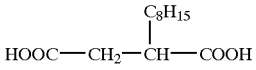

[RN=28805-58-5] or its anhydride are preferred compositions of the invention.

These compositions satisfy the stability/solubility criterion which is defined as follows: they are liquid, clear, stable for at least 60 days over a temperature range of −15° C./+40° C., and soluble in alkaline solutions.

They can be used to compose detergent washing products containing from 1 to 5 parts by weight of them in an aqueous sodium hydroxide or potassium hydroxide solution, or mixtures of alkali metal salts (sodium and/or potassium phosphates, carbonates or silicates), in which there is no need to introduce hydrotropic agents in order to ensure their homogeneity on storage. Such washing products are also subjects of the invention. These washing products can be used for cleaning hard surfaces, after immediate dilution at room temperature in soft or hard water.

EXAMPLES

In the non-limiting examples of the invention, the detergent power, the foaming power and the anti-foaming power were determined according to the following procedures.

Detergent Power

The detergent power is evaluated by degreasing a stainless steel plate whose soiling is obtained by dipping in a molten mixture of (parts by weight)

15 parts of stearic acid, 15 parts of oleic acid, 30 parts of rapeseed oil, 25 parts of a mineral oil (Elf 15W40)

8 parts of cetostearyl alcohol.

The detergent washing product consists of an aqueous 13% sodium hydroxide solution, containing 2.2% of the detergent composition to be tested.

The degreasing treatment is carried out in the Labomat machine from the company Mathis, the stainless steel plate being immersed in the pot (volume 500 ml) of the machine in 400 ml of the above washing product, and stirred for 15 minutes at a temperature of 70° C. The plate is then removed from the machine, rinsed with water and dried.

The soiling mixture has so-called limiting lubricant performance characteristics. Measurement of the residual lubrication of the plate treated as defined above is carried out in comparison with a plate free of grease (100% detergency) and a plate which has been degreased using the detergent washing product as defined above but not containing the detergent agent (0% detergency). For this, a ball-disk tribometer is used, which makes it possible to measure the coefficient of friction between a ball and the plate to be measured, the ball being subjected to an applied load of 2.6 kg and the plate rotating at a speed of 1.6 mm/s.

Foaming Power

A sample of 900 ml of the alkaline detergent washing product, as defined above, is subjected to vigorous stirring for 5 minutes, under the effect of a turbomixer rotating at 2000 rpm. The height of the foam as a function of time is measured, after stirring, in a two liter measuring cylinder. It is accepted that the product is sufficiently devoid of foaming power if the volume of foam, after stirring, is less than 50 ml.

Antifoaming Power

The anti-foaming power, which evaluates the ability of the composition to counter the foaming effect developed by the soaps formed by reaction of the alkaline washing products with the surface soilings they remove, is measured as above using 900 ml of alkaline detergent solution, but in the presence of 1 g/l of saponin. The anti-foaming power is measured by comparison with the values obtained, under the same conditions, for an alkaline detergent solution containing no saponin.

Example 1

The detergent composition is as follows (parts by weight)

| | |
|---|---|
| α-decyl-ω-chloronona (oxyethylene) | 35 |
| 2-ethylhexyl phosphate | 19 |
| octenylsuccinic anhydride | 46 |

It is prepared by simple mixing of its constituents. Deterflo®A210 was used here for the α-decyl-ω-chloronona (oxyethylene) and Beycostat®A081 from CECA S.A. was used for the 2-ethylhexyl phosphate. The composition is in the form of a clear, yellow, stable solution with a viscosity of about 180 mPas at 25° C., the pH of the aqueous 10% dispersion of which being 0.7. A detergent washing product consisting of an aqueous 13% sodium hydroxide solution, containing 2.2% of this composition, is stable.

The foaming power, evaluated as indicated above, in water at 25° TH, at a sodium hydroxide concentration of 5.3%, in the presence of 0.5, 1, 2 and 4 g/l of detergent composition and at a temperature of 50° C., after stirring for 5 minutes and leaving to stand for 15 minutes, is zero.

The detergent power is 80%.

The anti-foaming power, measured with 2 g/l of surface agent+1 g/l of saponin, is 130 ml at $T_o$ and 40 ml at $T_{4min}$; with 2 g/l of surface agent, but with no saponin, the anti-foaming power measured is 120 ml at $T_o$ and 40 ml at $T_{4min}$.

Example 2 (Counterexample)

A composition (parts by weight)

| | |
|---|---|
| α-decyl-ω-chloronona (oxyethylene) | 65 |
| phosphoric monoester/diester of 2-ethylhexyl | 35 |

which is thus free of octenylsuccinic derivative, leads to unstable washing products.

Example 3 (Counterexample)

A composition (parts by weight)

| | |
|---|---|
| α-decyl-ω-chloronona (oxyethylene) | 43 |
| octenylsuccinic anhydride | 57 |

which is thus free of phosphoric ester, leads to unstable washing products.

Example 4 (Comparative)

The alkaline washing product consisting of α-decyl-ω-chloronona(oxyethylene) as a 2.2% solution in a 13% sodium hydroxide washing product is not stable. It is, moreover, the immediate consequence of the known lack of solubility of α-decyl-ω-chloronona-(oxyethylene). Despite this instability, the foaming power and anti-foaming power tests were performed. The foaming power of such a washing product, compared with that of the test washing product of Example 1, is slightly lower, its anti-foaming power is slightly higher and its detergent power is 20% lower. The appearance of the surface cleaned according to the test is also poorer.

Example 5

The detergent composition is as follows (parts by weight):

| | |
|---|---|
| Dehypon ® LT 104 (Henkel) | 35 |
| 2-Ethylhexyl phosphate (Beycostat ®) A081; CECA S.A.) | 19 |
| Octenylsuccinic anhydride | 46 |

Dehypon ® LT 104 is a mixture of compounds of formula $H_3C—(CH_2)_m—(O—CH_2—CH_2)_{10}—O—(CH_2)_3—CH_3$ in which m is an integer ranging from 9 to 17.

The composition is prepared by simple mixing of its constituents. It is in the form of a stable, clear, yellow solution with a viscosity of about 200 mPa.s at 25° C., and the pH of its aqueous 10% dispersion is equal to 0.7.

A detergent washing product comprising (% by weight):

17% of tetrapotassium pyrophosphate,

14% of pure potassium hydroxide,

15% of sodium silicate (density: 1.33), and

2% of the detergent composition, is stable.

The foaming power, evaluated under the conditions of Example 1, is zero (less than 50 ml volume of foam).

The detergent power is comparable to that of Example 1.

Example 6

The detergent composition is as follows (parts by weight):

| | |
|---|---|
| Plurafac ® LF 221 (BASF) | 35 |
| 2-Ethylhexyl phosphate (Beycostat ® A081; CECA S.A.) | 20 |
| Octylsuccinic anhydride | 45 |

Plurafac ® LF 221 is a mixture of compounds of formula

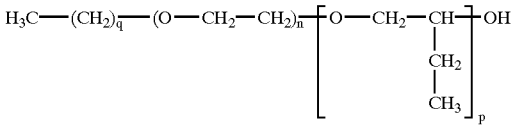

in which q is an integer ranging from 8 to 9, the average value of n is equal to 8.3 and the average value of p is equal to 1.6.

The composition is prepared by simple mixing of its constituents. It is in the form of a stable, clear, yellow solution with a viscosity of about 200 mPa.s at 25° C., and the pH of its aqueous 10% dispersion is equal to 0.7.

A detergent washing product comprising (% by weight):

17% of tetrapotassium pyrophosphate,

14% of pure potassium hydroxide,

15% of sodium silicate (density: 1.33), and 2.5% of the detergent composition, is stable.

The foaming power, evaluated under the conditions of Example 1, is zero (less than 50 ml volume of foam).

The detergent power is comparable to that of Example 1.

Example 7

The detergent composition is as follows (parts by weight):

| | |
|---|---|
| Non-foaming detergent | 35 |
| 2-Ethylhexyl phosphate (Beycostat ® A081; CECA S.A.) | 19 |
| Octylsuccinic anhydride | 46 |

The non-foaming detergent corresponds to the formula:

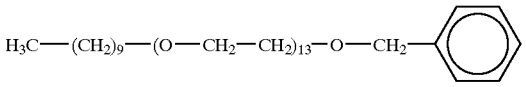

It is obtained by reacting the corresponding ethoxylated fatty alcohol with benzyl chloride.

The composition is prepared by simple mixing of its constituents. It is in the form of a stable, clear, yellow solution with a viscosity of about 200 mPa.s at 25° C., and the pH of its aqueous 10% dispersion is equal to 0.7.

A washing product comprising (% by weight):

17% of tetrapotassium pyrophosphate,

14% of pure potassium hydroxide,

15% of sodium silicate(density: 1.33), and 2.2% of the detergent composition, is stable.

The foaming power, evaluated under the conditions of Example 1, is zero (less than 50 ml volume of foam).

The detergent power is comparable to that of Example 1.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 98.08608 published as FR 2780732, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A detergent composition for industrial or household cleaning, which is non-foaming and stable in a highly alkaline NaOH medium, comprising, in a solution of a highly alkaline medium of at least about 13% of sodium hydroxide, 25 to 45 parts by weight of a non-foaming detergent agent, 15 to 25 parts by weight of a stablizer, 30 to 60 parts by weight of alkenylsuccinic acid or anhydride, the non-foaming detergent agent being a compound of formula

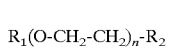

in which $R_1$ is an alkyl chain of 8–20 carbon atoms, or an octylphenyl or nonylphenyl radical, n is from 8 to 15, $R_2$ is an alkoxy radical of 3–5 carbon atoms, a poly (oxyalkylene) radical of formula:

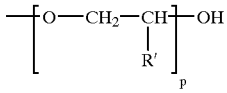

in which $R^1$-is an alkyl radical containing 1 or 2 carbon atoms, and p is from 1 to 10, a benzyloxy radical, or chlorine;

the stabilizer being a phosphoric mono- or diester obtained by reaction of phosphorus pentoxide with an aliphatic alcohol containing from 4 to 12 carbon atoms;

the alkenylsuccinic acid being a compound of formula

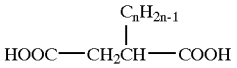

where n is from 4 to 12, or an anhydride thereof.

2. A detergent composition according to claim 1, wherein the non-foaming detergent agent is decyl-ω-chloronona (oxyethylene), of formula or α-decyl-ω-benzyloxytrideca (oxyethylene), of formula

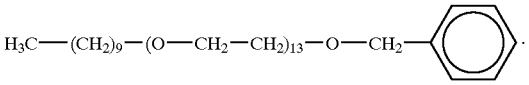

3. A detergent composition according to claim 1, wherein the stabilizer is a phosphoric monoester/diester of 2-ethylhexyl.

4. A detergent composition according to claim 1, wherein the alkenylsuccinic acid or anhydride is octenylsuccinic acid or anyhydride.

5. A detergent composition according to claim 1, wherein the non-foaming detergent agent is α-decyl-ω-chloronona (oxyethylene), of formula $CH_3(CH_2)_9$-$(O$-$CH_2$-$CH_2)_9$-Cl,

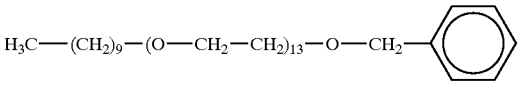

the stabilizer is a phosphoric monoester/diester of 2-ethylhexyl, and the alkenylsuccinic acid or anhydride is octenylsuccinic acid or anhydride thereof.

6. A detergent composition according to claim 1, wherein $R_1$ is an alkyl chain of 8–12 carbon atoms.

7. A detergent washing product comprising a solution containing 1–5% by weight of a detergent composition according to claim 1 in said solution of sodium hydroxide.

8. A detergent washing product comprising a solution containing 1–5% by weight of a detergent composition according to claim 2 in said solution of sodium hydroxide.

9. A detergent washing product comprising a solution containing 1–5% by weight of a detergent composition according to claim 3 in said solution of sodium hydroxide.

10. A detergent washing product comprising a solution containin 1–5% by weight of a detergent composition according to claim 4 in said solution of sodium hydroxide.

11. A detergent washing product comprising a solution containing 1–5% by weight of a detergent composition according to claim 5 in said solution of sodium hydroxide.

12. A method of cleaning a hard surface, comprising washing the hard surface with the product according to claim 6.

13. A method of cleaning a hard surface, comprising washing the hard surface with the product according to claim 7.

14. A method of cleaning a hard surface, comprising washing the hard surface with the product according to claim 8.

15. A method of cleaning a hard surface, comprising washing the hard surface with the product according to claim 9.

16. A method of cleaning a hard surface, comprising washing the hard surface with the product according to claim 10.

17. A detergent composition for industrial or household cleaning which is non-foaming and stable in a highly alkaline NaOH medium comprising, in a solution of a highly alkaline medium of at least about 13% of sodium hydroxide, 25 to 45 parts by weight of a non-foaming detergent agent, which is decyl-ω-chloronona(oxyethylene) of the formula $CH_3$-$(CH_2)9$-$(OCH_2$-$CH_2)_9$ -C1

15 to 25 parts by weight of a stablizer, 30 to 60 parts by weight of octenylsuccinc anhydride.

* * * * *

UNITED STATES PATENT AND TRADEMARK OFFICE

CERTIFICATE OF CORRECTION

PATENT NO. : 6,693,065 B2 
DATED : February 17, 2004
INVENTOR(S) : Gentilhomme, Philipp et al.

It is certified that error appears in the above-identified patent and that said Letters Patent is hereby corrected as shown below:

Column 7,
Line 2, after the word "is" please insert the following:
-- α- --
Line 3, after "formula", insert -- or $CH_3$ -$(CH_2)_9$ -$(O\text{-}CH_2\text{-}CH_2)_9$ -Cl, --
Line 7, after the first formula insert the following:
-- or α-decyl-ω-benzyloxytrideca(oxyethylene), of formula --

Column 8,
Line 7, before the word "decyl" add the following:
-- α- --

Signed and Sealed this

Sixteenth Day of November, 2004

JON W. DUDAS
*Director of the United States Patent and Trademark Office*